US005429571A

United States Patent [19]

Smith et al.

[11] Patent Number: 5,429,571

[45] Date of Patent: Jul. 4, 1995

[54] PERSONAL TRAINER

[75] Inventors: Fred T. Smith; Fred P. Smith, both of Alpine, Utah

[73] Assignee: Product Innovations and Sales Company, L.C., Alpine, Utah

[21] Appl. No.: 118,183

[22] Filed: Sep. 9, 1993

[51] Int. Cl.[6] ..... A63B 21/012

[52] U.S. Cl. ..... 482/115; 482/114; 482/904

[58] Field of Search ..... 482/114, 120, 115, 904, 482/116; 182/5, 191

[56] References Cited

U.S. PATENT DOCUMENTS

| | | | |
|---|---|---|---|
| 518,967 | 5/1894 | Poole | 482/116 |
| 666,028 | 1/1901 | Schaeffer | 182/5 |
| 4,588,045 | 5/1986 | Walker, Sr. | 182/191 |
| 5,048,825 | 9/1991 | Kelly | 482/904 |
| 5,090,503 | 2/1992 | Bell | 182/5 |

*Primary Examiner*—Richard J. Apley
*Assistant Examiner*—Lynne A. Reichard
*Attorney, Agent, or Firm*—Ellsworth R. Roston; Charles H. Schwartz

[57] ABSTRACT

A pair of pivotable arms in a clamp in a personal trainer may be spring biased to a closed position as on a door frame. A lock retaining the clamp in the closed position includes a member manually actuatable to release the clamp from the door frame. A clasp on the clamp holds a first belt in a wrapped and frictional relationship. In one embodiment, the second end of the first belt is retained by a resistance unit which is disposed on a handle adapted to be manually gripped by the user. The resistance unit has bars which receive the belt in a frictional and tensioning relationship to retain the belt. Collars on the handle retain a harness shaped to envelope the user's face. The harness may be moved or rotated relative to the handle to exercise muscles in selective portions (e.g. neck or back) of the user's body. In another embodiment, a second belt engaged by the resistance unit extends beyond the resistance unit. At its extending end, the second belt is looped upon itself to define a stirrup for receiving the user's foot. When the foot is disposed in the stirrup, various exercises may be performed by gripping the handle, tensioning the second belt on the handle and alternately raising and lowering the handle. Tensioning the second belt on the handle provides resistance in the resistance unit as the handle is moved upwardly and downwardly on the belt, the resistance magnitude being dependent upon the tension magnitude.

31 Claims, 4 Drawing Sheets

FIG. 1
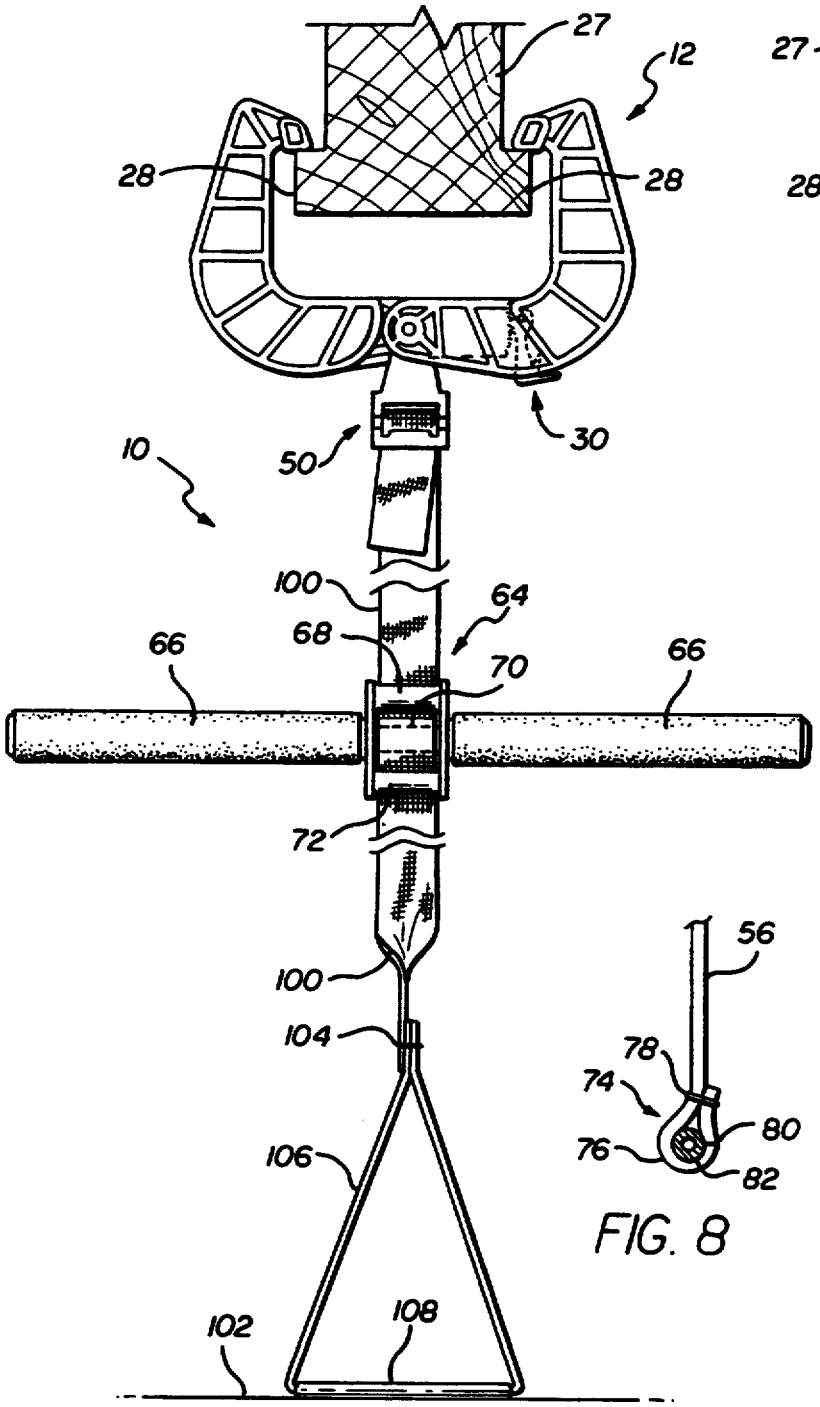
FIG. 2
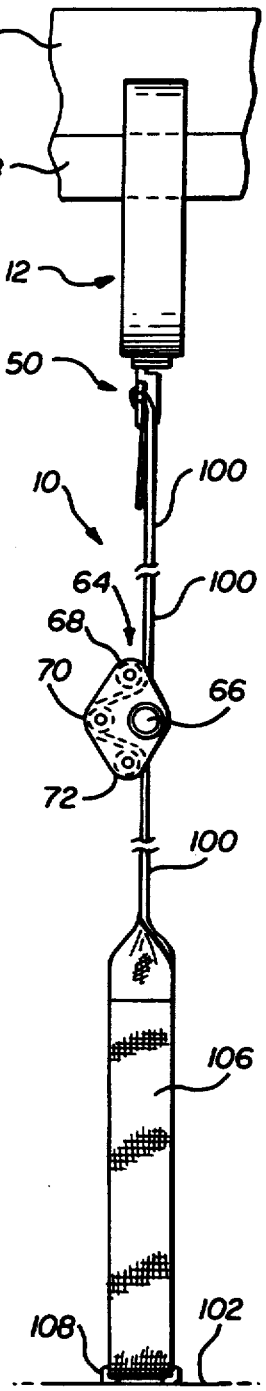
FIG. 8

FIG. 3
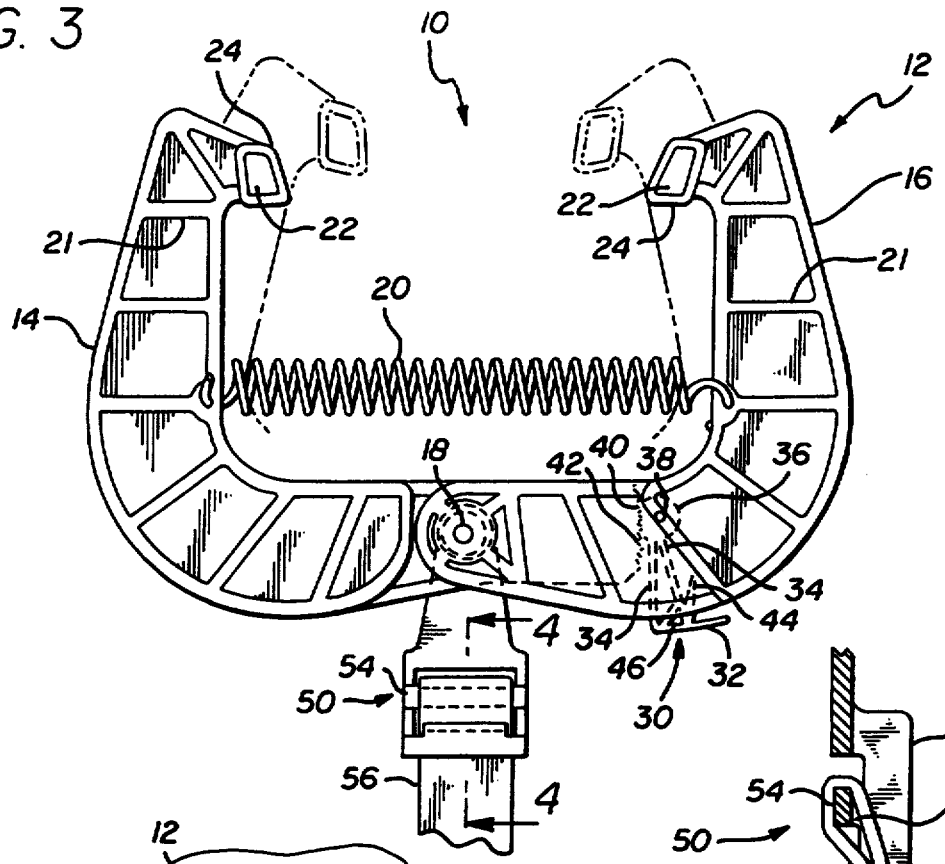
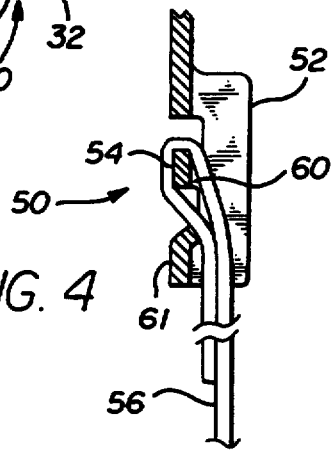
FIG. 4
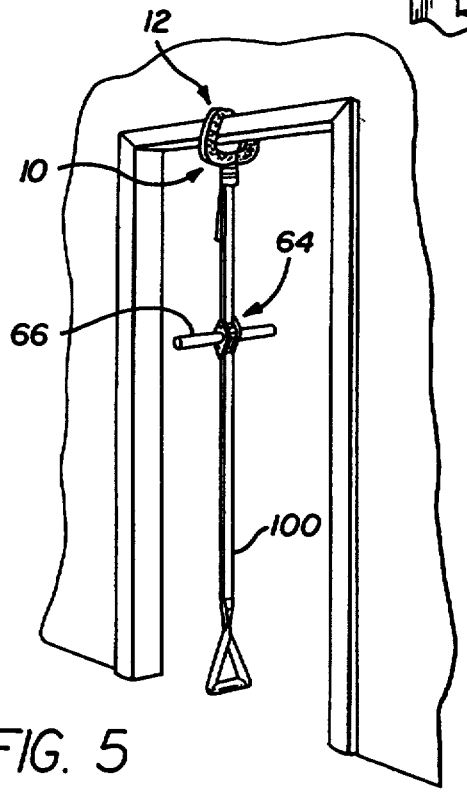
FIG. 5
FIG. 9
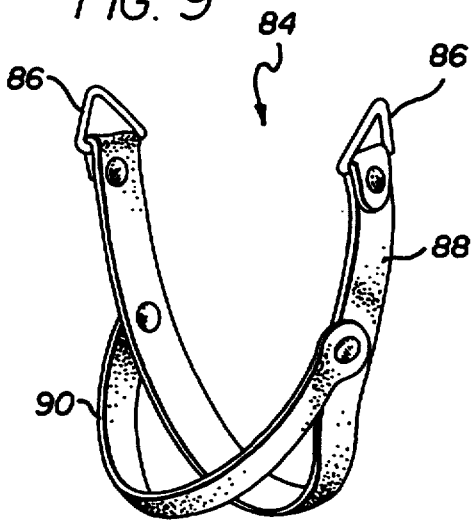

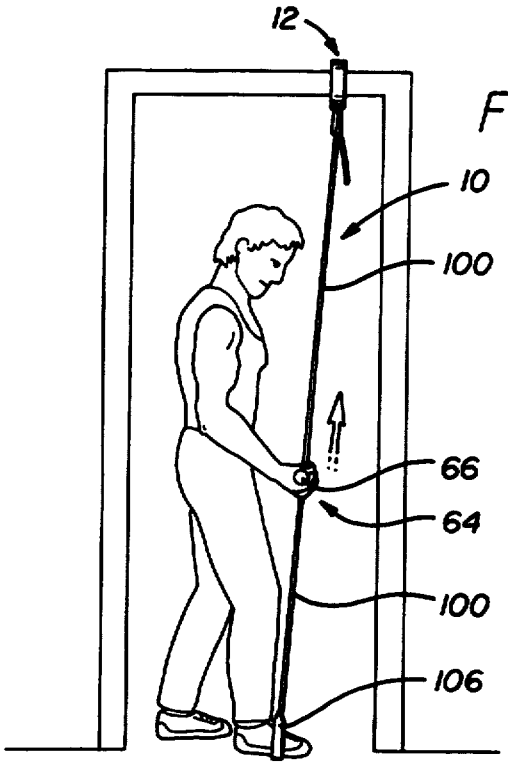
FIG. 6
FIG. 7
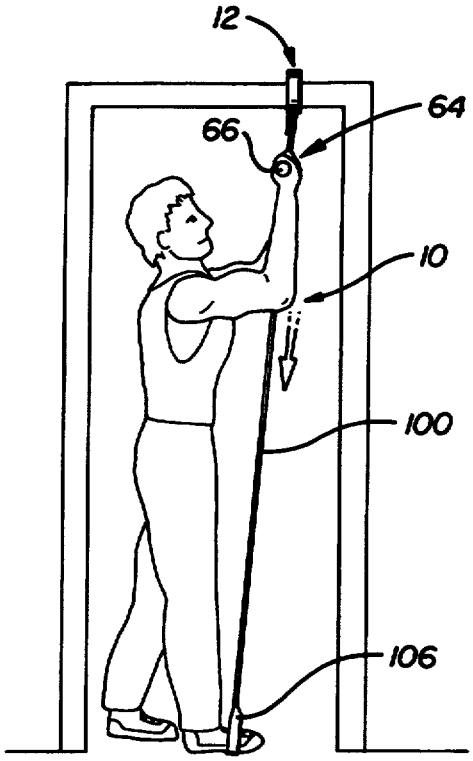
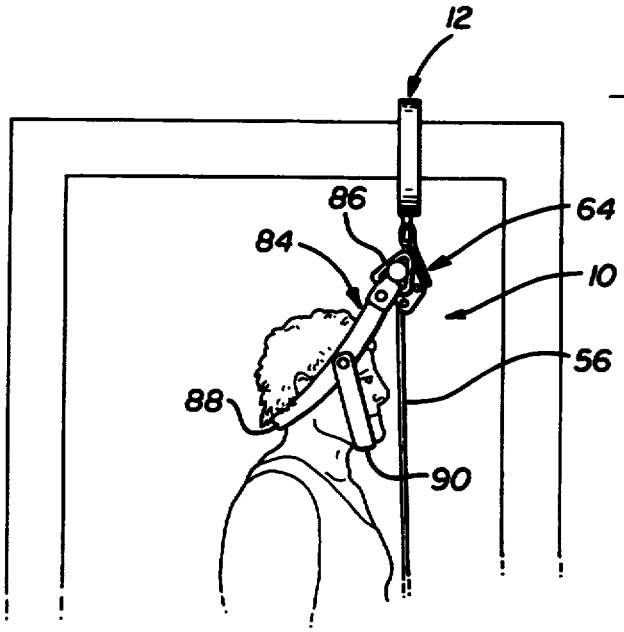
FIG. 10

PERSONAL TRAINER

This invention relates to a personalized trainer. More particularly, the invention relates to a personalized trainer which is light in weight, adaptable to exercise many different muscles in the user's body, compact when not in use, easily portable and readily affordable.

Exercising apparatus has become the vogue. People spend inordinately large sums of money to buy specialized equipments which exercise only a limited number of muscles in the user's body. The equipment are often large and cumbersome. They are certainly not portable. Many are not efficient. They are not adaptable to exercise different portions of a user's body. They are often not readily adaptable for use.

After purchasing the equipment, the purchasers generally use the equipment for a while and then lose interest or become discouraged from use. Exercise equipments have accordingly acquired a reputation in some circles as a bad investment. In view of this, many people hesitate to buy exercise equipment, particularly if the equipment has any of the limitations specified above.

In spite of the disadvantages in the previous paragraph, the desirability of performing exercises on a systematic basis is still appreciated. Such exercise tends to limit a person's weight and to enhance his physical well being and his appearance. It also tends to enhance his psychological attitude positively. It is also well recognized that it would be desirable to have the equipment portable, compact, inexpensive and easily operated. In spite of the recognition for some time of the desirable features discussed in this paragraph, satisfactory exercise equipment has not been provided even though a considerable effort has been made to provide exercise equipment which fulfills such criteria.

This invention provides a personal trainer which meets the above criteria. It is adaptable to exercise muscles in different portions of a user's body. It is light in weight and is compact so that it is easily portable. For example, it may be carried in a user's briefcase or suitcase. It has essentially no moving parts other than a belt or a handle so that it cannot break down or wear out. It is relatively inexpensive.

In one embodiment of the invention, a personal trainer provides for selective exercising of different muscles in a user's body. A pair of pivotable arms in a clamp in the personal trainer may be spring biased to a closed position as on a door frame. A lock retaining the clamp in the closed position includes a member manually actuatable to release the clamp from the door frame. A clasp on the clamp holds a first belt in a wrapped relationship and provides a frictional force on this belt in the wrapped relationship.

In one embodiment, the second end of the first belt is retained by a resistance unit which is disposed on a handle adapted to be manually gripped by the user. The resistance unit has bars which receive the belt in a frictional relationship to retain the belt. Collars on the handle retain a harness shaped to envelope the user's face. The harness may be moved or rotated relative to the handle to exercise muscles in selective portions (e.g. the neck or back) of the user's body.

In another embodiment, a second belt engaged by the resistance unit extends beyond the resistance unit. At its extending end, the second belt is looped upon itself to define a stirrup for receiving the user's foot. When the foot is disposed in the stirrup, various exercises may be performed by gripping the handle tensioning the second belt on the handle and alternately raising or lowering the second belt. Tensioning the second belt on the handle provides resistance in the resistance unit as the handle is moved upwardly and downwardly, the resistance magnitude being related to the tension magnitude.

In the drawings:

FIG. 1 is a front elevational view of one embodiment of a personal trainer included in this invention, with the personal trainer clamped on a wall over a door frame;

FIG. 2 is a side elevational view of the embodiment of the personal trainer shown in FIG. 1;

FIG. 3 is an enlarged fragmentary view of a clamp in the personal trainer with the clamp shown open in solid lines and partially closed in broken lines;

FIG. 4 is a sectional view taken substantially on the line 4—4 of FIG. 3 and showing in additional detail the construction of a clasp included in the personal trainer of FIGS. 1-3;

FIG. 5 is a perspective view of the personal trainer shown in FIGS. 1-4 with the clamp in the closed position on a wall over a door frame;

FIG. 6 is a side elevational view of the embodiment of the personal trainer shown in FIGS. 1-5 and illustrates how a user operates the embodiment of the personal trainer to exercise certain muscles in the user's body;

FIG. 7 is a side elevational view similar to that shown in FIG. 6 and illustrates further how the user continues to operate the embodiment of the personal trainer shown in FIGS. 1-6 to exercise the same muscles as in FIG. 6;

FIG. 8 is a fragmentary side elevational view of a belt included in another embodiment of a personal trainer constituting this invention;

FIG. 9 is an enlarged perspective view of a harness included in the embodiment shown in FIG. 8;

FIG. 10 is a side elevational view of the embodiment shown in FIG. 9 and illustrates how a user operates the embodiment shown in FIGS. 8 and 9 to exercise muscles in the user's body.

Figure 11:
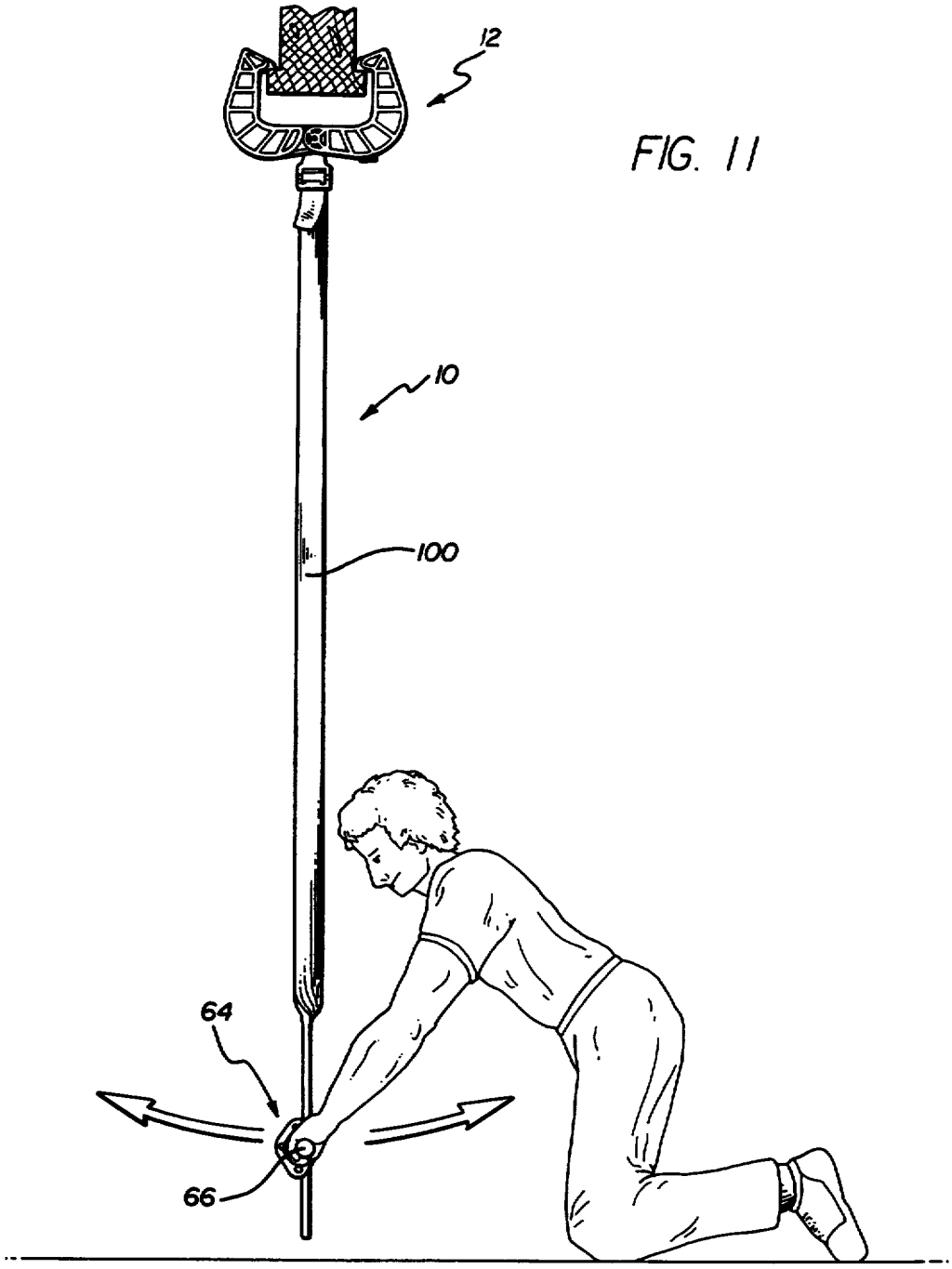
FIG. 11 illustrates how the user can operate the embodiment shown in FIGS. 1-7 to exercise the user's stomach muscles.

In one embodiment of the invention, a personal trainer generally indicated at 10 (FIGS. 1-11) is provided. The personal trainer 10 includes a clamp generally indicated at 12. The clamp 12 is defined by a pair of arms 14 and 16 pivotable relative to each other on a pivot pin as at 18. The arms 14 and 16 may be made from a suitable material such as a plastic. The clamp 12 may be biased to the closed position by a constrainable member such as a spring 20 which is connected at its opposite ends in compression to the arms 14 and 16. The arms 14 and 16 may be defined as by spaced struts 21 to minimize the weight of the clamp 12.

The arms 14 and 16 may be provided at their free ends with pins 22 which are integral with the arms. Cushioning members 24 may envelope the pins 22. The cushioning members 24 may be made from a suitable material such as a plastic to facilitate the gripping of a wall 27 above a door frame 28 in the closed position of the clamp 12. Alternatively, the cushioning members 24 may grip a hook in the ceiling on any other member suitable for providing support. The cushioning members 26 may be somewhat resilient to provide a damping and cushioning action on any force exerted against the wall 27 when the arms 14 and 16 are closed against this wall. As will be seen in FIG. 1, the clamp 12 is closed with the arms 14 and 16 positioned against the wall above the door frame.

The clamp 12 may be locked in the closed position as by a locking mechanism generally indicated at 30. The locking mechanism 30 may be made from a resilient plastic material. The locking mechanism 30 includes a member 32 having a pair of fingers 34 which extend at an acute angle relative to each other from a core portion 36. A pin 38 extends from the core portion 36 into one of the struts 21 to define a fulcrum for the locking member 30. The core portion 36 may have a threaded periphery as at 40 at the end opposite the pin 38. The threads 40 mate with threads 42 in one of the struts 21 in the unstressed relationship of the locking mechanism 30. A leaf spring 44 extends from a thumb nail portion 46 in the locking mechanism 30.

A clasp generally indicated at 50 (FIGS. 3 and 4) is supported from the clamp 12 by the pivot pin 18. The clasp 50 includes a body portion 52 and a post 54 extending from the body portion for retaining a resilient belt 56 made from a relatively heavy cloth material. The post 54 defines a space 60 for receiving the belt 56 in a relationship where the belt is wrapped around the post to define two (2) portions of the belt in frictional relationship with each other. Another post 61 presses the two (2) frictional portions of the belt 56 against the body portion 52 to enhance the frictional relationship. In this way, the belt 56 is retained in a fixed relationship by the clasp 50. The belt 56 may be made from a suitable material such as nylon. This material is advantageous because it conducts and transmits heat well.

A resistance unit generally indicated at 64 (FIGS. 1 and 2) holds the bottom end of the belt 56 in a fixed relationship. The resistance unit 64 may be made from a suitable material such as a melamine or a phenolic. This material is advantageous because it does not conduct heat well. This causes the heat generated by friction between the resistance unit 64 and the strap 56 to be absorbed and dissipated by the strap. The resistance unit 64 is disposed at an intermediate position along the length of gripping means such as a handle 66 which is constructed and shaped to be gripped comfortably by the hands of the user. For example, the handle 66 may have a long cylindrical configuration. The resistance unit 64 may include a plurality of stationary bars 68, 70 and 72 (FIG. 2) vertically spaced from one another in a horizontally staggered or sinuous relationship. A button generally indicated at 74 (FIG. 8) is disposed on the belt 56 at the bottom end of the belt for retention in the space between the bars 70 and 72. The button 74 may be formed by providing a loop 76 in the belt 56 and by sewing the end of the loop 76 to the belt as at 78. Further loops 80 and 82 may be disposed in the loop 76 to form the button 74.

A harness generally indicated at 84 (FIG. 9) is supported on the handle 66 as by a pair of spaced collars 86 removably disposed on the handle at opposite ends from the clasp 64. The harness 84 may be made from a suitable material such as leather. The harness 84 includes a loop 88 of material and a strap 90 supported by the loop 88 at intermediate positions between the collars 86 and the bottom of the loop. The loop 88 is adapted to be disposed against the back of the user's head and the strap 90 is adapted to be disposed under the user's chin. This is shown schematically in FIG. 10.

To make operative the embodiment of the personal trainer 10 shown in FIGS. 1–4 and 8–10, the clamp 12 is initially opened by manually pressing against the thumbnail portion 46 of the locking mechanism 30. This causes the core portion 36 to rotate in a clockwise direction on the pin 38 as a fulcrum so that the teeth 40 on the locking mechanism become disengaged from the teeth 42 on the strut 21. The arms 14 and 16 are then rotated relative to each other on the pin 18 as a fulcrum to separate the arms. The arms 14 and 16 are then disposed on the opposite sides of the wall 27 above the door frame 28. The arms 14 and 16 are thereafter released on a controlled basis to engage the opposite sides of the wall 27. The clamp 26 is prevented by the frame 28 from sliding downwardly below the frame.

The user then inserts his head into the harness 84 in the manner shown in FIG. 10 and described above. The user then can provide controlled exercises. For example, the user can exercise the user's neck muscles by twisting his head. The user can also exercise the user's back muscles by maintaining the user's head stationary and by rotating the user's body alternately in a clockwise and counter clockwise direction. The operation of the user in providing the desired muscle exercises is facilitated when the user manually grips the handle 66.

In another embodiment shown in FIGS. 1–7, the belt 56 can be replaced by a belt 100. The belt 100 is disposed on the clasp 50 in a manner similar to that described above for the belt 56. The belt 100 is also disposed on the resistance unit 64 in a manner similar to that described above for the belt 56. However, the belt 90 extends below the resistance unit 64 for a sufficient distance to reach the floor 102. A member having a looped configuration is attached to the belt as by threads as at 104 (FIG. 1) to define a stirrup 106 for insertion of the user's foot into the stirrup. The bottom end of the stirrup 106 may be reinforced with a rigid member 108 to receive and support the user's foot.

When the user inserts his foot into the stirrup 106, the user can use the personal trainer 10 to exercise various portions of his body. For example, the user can alternately squat and stand to exercise the muscles in his legs. The personal trainer 10 is able to provide such exercises because the resistance unit 64 develops considerable friction against the belt 100 when the user attempts to move the handle 66 upwardly and downwardly. The friction is developed in the resistance unit 64 when tension is imposed on the belt 100 in moving the gripping means such as the handle 66 upwardly or downwardly.

The combination of the resistance unit 64 and the belt 100, and the materials from which these members are made, prevent the resistance unit from becoming hot when the handle 66 is moved upwardly and downwardly. This prevents the handle 66 from becoming hot. This is important in ensuring that the user will be able to grasp the handle 66 even after the user has operated the personal trainer 10 for some time.

As previously described, heat is generated in the belt 100 when the handle 66 is moved upwardly and downwardly. Since the heat is generated along an extended length of the belt 100 when the handle 66 is moved along this extended length, the generated heat is dissipated by the belt 100 along this extended length. Furthermore, the heat is dissipated from both sides of the belt 100 since the heat is generated at both sides of the belt as the belt traverses the bars 68, 70 and 72. This provides for an effective dissipation of the heat generated by the friction of the belt 100 against the bars 68, 70 and 72 in the resistance unit 100. It also provides for a long life for the belt 100 since the belt tends to become worn evenly on both sides of the belt.

The combination of the materials for the resistance unit 64 and the belt 100 offers certain additional advantages of some importance. These materials cause the static friction developed between the resistance unit 64 and the belt 100 as a result of the upward and downward movements of the handle 66 to approximate the dynamic coefficient of friction during such movements. If the static and dynamic coefficients of friction differ by a considerable value, the resistance unit 64 "sticks" at the beginning of each upward and downward movement of the handle 66. This prevents the upward and downward movements of the handle 66 from being smooth.

The resistance unit 64, the handle 66 and the belt 100 are designed so that no torque is imposed on the handle when the handle is moved upwardly and downwardly. This results from the fact that the handle 66 pulls in a direct line with the belt 100. In other words, the belt 100 pulls through the center of the handle 66 (as seen in a lateral direction) so as not to impose any torque on the belt 100.

The weaving of the belt 100 through the bars 68, 70 and 72 provides a sufficient resistance to hold the handle 66 at any position that the handle is disposed on the belt. In view of this, the handle 66 may be disposed on the belt 100 in a non-slidable relationship a few inches from the floor as shown in FIG. 11. As shown in FIG. 11, the user can kneel in front of the handle 66, grasp the handle and provide a swinging motion of the handle in a pendulum relationship. This provides an excellent exercise for the user's stomach muscles. The user can adjust the amount of help that the user receives from the belt 100 in rising from the kneeling position by adjusting the arc of the pendulum swing.

The embodiment shown in FIGS. 1–7 can also disposed to allow the user to provide knee bends. In performing these exercises, the user can adjust the height of the handle 66 to any desired or comfortable level. The handle 66 provides stability to the user as the user performs the knee bends. Performing knee bends is a simple exercise that involves the use of a considerable portion of the user's muscles. This exercise may be especially important for an elderly user since the user can adjust the height of the handle 66 to perform shallow knee bends and use his arms to help him adjust to an upright position.

FIGS. 6 and 7 illustrate an exercise by the user of the user's back muscles when the user is in an upright position. The movement of the handle 66 upwardly on the belt 100 with the user in an upright position is shown in FIG. 6. The movement of the handle 66 downwardly with the user in an upright position is shown in FIG. 7. A considerable restraint is provided by the belt 100 against the downward movement of the handle 66 as shown in FIG. 7. The user can also exercise the user's back muscles by disposing the handle at an intermediate level and pressing downwardly on the handle 66. The user can also exercise the user's back muscles in a squat position and by operating the personal trainer in the manner shown in FIGS. 6 and 7.

The personal trainer 10 has certain important advantages. It essentially has no moving parts except for the pivotable relationship of the arms 14 and 16 and the locking mechanism 30 and the movements of the handle 66. Since there are essentially no moving parts, it is long lasting. Furthermore, since there are essentially no moving parts, the personal trainer cannot develop defects. The personal trainer is light in weight and relatively compact so that it can be easily and conveniently carried in the user's suitcase or briefcase. It can be used to exercise a considerable number of different muscles in the user's body. It can be easily disposed on the wall 27 above the door frame 28 when its use is desired or it can be easily removed from the wall 27. It can be used comfortably for long periods of time since any heat generated during its use is dissipated efficiently by members such as the belt 100.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination in a personal trainer for support on a supporting structure to provide exercise for a user, clamping means defined by a pair of members pivotable relative to each other between an open relationship for disposition on the supporting structure and a closed position for retention on the supporting structure, first means associated with the members for manually locking the clamping means in the closed relationship to the supporting structure and for manually releasing the clamping means to the open relationship providing for a release of the clamping means from the supporting structure, gripping means constructed to be manually gripped by the user, and a belt providing a coupling between the clamping means and the gripping means, the belt extending beyond the gripping means for coupling to a particular portion of the user's body to provide for an exercising of particular muscles in the user's body.

2. In a combination as set forth in claim 1, means attached to the portion of the belt extending, beyond the gripping means and defining a loop for insertion of the user's foot to facilitate leg and back exercises by the user.

3. In a combination as set forth in claim 1, means disposed on the gripping means for retaining the belt on the gripping means and means disposed on the clamping means for retaining the belt on the clamping means.

4. In a combination as set forth in claim 1 wherein a spring is disposed between the members for maintaining the members in a clamped relationship.

5. In combination in a personal trainer for support on a support structure to provide exercise for a user, clamping means defined by a pair of pivotable arms having opened and closed positions, the clamping means being operable in the open position to become disposed on the support structure and being operable in the closed position to be retained on the support structure, gripping means shaped to be manually gripped by the user, first means operatively coupled to the clamping means for retaining the clamping means in the closed position, belt means extending between the clamping means and the gripping means, second means operatively coupled to the clamping means for retaining the belt means on the clamping means, third means operatively coupled to the belt means and the gripping means for retaining the belt means on the gripping means and for facilitating the exercising of muscles in a particular portion of the user's body, the third means being made from a material providing a low heat conductivity, and the belt means being made from a material providing a high heat conductivity.

6. In a combination as set forth in claim 5 wherein the retaining means includes means operatively coupled to the clamping means and having first and second operative relationships for locking the clamping means in the closed position of the clamping means in the first operative relationship and for providing for the opening of the clamping means in the second operative relationship.

7. In a combination as set forth in claim 6, the retaining means also including constraining means operatively coupled to the clamping means for biasing the clamping means to the closed relationship.

8. In a combination as set forth in claim 6, the retaining means including a spring disposed in compression for maintaining the clamping means in the clamped relationship.

9. In combination in a personal trainer for support on a support structure to provide exercise for a user, clamping means defined by a pair of pivotable arms having opened and closed position the clamping means being operable in the open position to become disposed on the support structure and being operable in the closed position to be retained on the support structure, gripping means shaped to be manually gripped by the user, first means operatively coupled to the clamping means for retaining the clamping means in the closed position, belt means, second means operatively coupled to the clamping means and the gripping means for retaining the belt means on the clamping means and the gripping means, and third means operatively coupled to the belt means and the gripping means for facilitating the exercising of muscles in a particular portion of the user's body the second means including bars disposed on the gripping means for receiving and retaining the belt means.

10. In combination in a personal trainer for support on a support structure to provide exercise for a user, clamping means having a first relationship for disposition on the support structure and having a second relationship for removal from the support structure, gripping means for manual gripping by the user, support means operatively coupled to the clamping means, resistance means operatively coupled to the gripping means, belt means extending in a linear direction between the support means and the resistance means for supporting the gripping means from the clamping means, and holding means supported by the gripping means and including an integral extension of the belt means for providing for the insertion of a selective portion of the user's body into the holding means to facilitate the exercise by the user of muscles in different portions of the user's body dependent upon the selective portion of the user's body inserted into the holding means.

11. In a combination as set forth in claim 10 wherein the holding means constitutes a loop for receiving and holding one of the user's feet and further includes a portion of the belt means extending between the loop and the second support means.

12. In a combination as set forth in claim 10, retaining means have first and second operative relationships and operatively coupled to the clamping means in the first relationship for locking the clamping means for disposition on the door frame, the retaining means including a member manually operable to provide the retaining means in the second relationship for obtaining a release of the clamping means from the door frame.

13. In combination in a personal trainer for support on a support structure to provide exercise for a user, clamping means having a first relationship for disposition on the support structure and having a second relationship for removal from the support structure, gripping means for manual gripping by the user, support means operatively coupled to the clamping means, resistance means operatively coupled to the gripping means, belt means extending between the first and second support means for supporting the gripping means from the clamping means, and holding means supported by the gripping means for providing for the insertion of a selective portion of the user's body into the holding means to facilitate the exercise by the user of muscles in different portions of the user's body dependent upon the selective portion of the user's body inserted into the holding means, the resistance means includes a plurality of bars for receiving the belt means in a threaded relationship to provide for constraints of the belt means relative to the gripping means upon the imposition of a force on the gripping means in opposite directions, the bars being made from a material providing a low heat conductivity, and the belt means being made from a material providing a high heat conductivity.

14. In a combination as set forth in claim 13 wherein the belt means constitutes a single belt extending the support means and in the threaded relationship on the bars in the resistance means to provide a frictional relationship between the bars and the opposite surfaces of the belt and wherein the holding means includes a loop for receiving one of the user's feet to facilitate exercises of the muscles in the user's legs.

15. In a combination as set forth in claim 14 wherein the opposite ends of the loop are connected to the belt means.

16. In combination in a personal trainer for support on a support structure to provide exercise for a user, clamping means defined by a pair of arms pivotable between first and second operative relationships and operative in the first relationship to become clamped to the support structure and operative in the second relationship to be removed from the support structure, first means operatively coupled to the clamping means for biasing the clamping means to the first operative relationship, second means for providing for a manual gripping by the user, third means disposed on the clamping means for providing a first coupling, fourth means disposed on the second means for providing a second coupling, belt means operatively coupled to the third and fourth means for supporting the second means from the clamping means, and fifth means extending beyond the second means; the third means and the fourth means for retention of a selected portion of the user's body to provide for exercises of muscles in such selected portion of the body.

17. In a combination as set forth in claim 16 wherein the belt means constitutes a single belt disposed on the third means and the fourth means and extends beyond the fourth means.

18. In a combination as set forth in claim 17 wherein the single belt extends in a linear direction between the third means and the fourth means and extends in the linear direction beyond the fourth means.

19. In a combination as set forth in claim 16, sixth means operatively coupled to the clamping means and having first and second manually operative relationships with the clamping means and manually operative to lock the clamping means in the first operative relationship to the support structure and manually operative to provide for the release of the clamping means from the support structure in the second relationship.

20. In a combination as set forth in claim 19, the first means including a spring connected to the arms for biasing the clamping means to the first operative relationship of the clamping means.

21. In combination in a personal trainer for support on a support structure to provide exercise for a user, clamping means defined by a pair of arms pivotable between first and second operative relationships and operative in the first relationship to become clamped to the support structure and operative in the second relationship to be removed from the support structure, first means operatively coupled to the clamping means for biasing the clamping means to the first operative relationship, second means for providing for a manual gripping by the user, third means disposed on the clamping means for providing a first coupling, fourth means disposed on the second means for providing a second coupling, belt means operatively coupled to the third and fourth means for supporting the second means from the clamping means, and fifth means extending from the second means for retention of a selected portion of the user's body to provide for exercises of muscles in such selected portion of the body, the belt means constituting a single belt disposed on the third means and the fourth means and extending beyond the fourth means, the third means constituting a clasp for receiving and retaining the single belt, the fourth means constituting resistance means for receiving and retaining the single belt, the single belt extending beyond the resistance means, and means defining a loop and connected to the single belt at a position beyond the resistance means for receiving and retaining a foot of the user.

22. In a combination as set forth in claim 21 wherein the clasp includes a first pin for holding the single belt in a wrapped relationship and a second pin for pressing against the single belt in the wrapped relationship to provide friction on the belt.

23. In a combination as set forth in claim 21 wherein the resistance unit includes a plurality of bars for holding the single belt in a frictional relationship when the single belt is tightened against the pulleys.

24. In combination in a personal trainer for support on a support structure to provide exercise for a user, gripping means, a belt having first and second operative surfaces, a resistance unit disposed on the gripping means and constructed to receive the belt in a sinuous relationship of the belt to provide a tension on the belt when a tension is imposed on the gripping means, the resistance unit being constructed and disposed relative to the belt to receive and apply friction to the first and second opposite surfaces of the belt, and means for supporting the belt on the support structure, the belt extending in an integral and linear relationship between the resistance unit and the supporting means.

25. In combination in a personal trainer for support on a support structure to provide exercise for a user, gripping means, a belt having first and second opposite surfaces, a resistance unit disposed on the gripping means and constructed to receive the belt in a sinuous relationship of the belt and disposed to provide a friction to the first and opposite surfaces of the belt and to provide a tension on the belt when a tension is imposed on the gripping means, and means for supporting the belt on the support structure, the resistance unit including a plurality of bars spaced from one another in a first direction and disposed in a sinuous relationship in a second direction transverse to the first direction to impose a frictional force on the first and second opposite surfaces of the belt when a tension is imposed on the gripping means.

26. In a combination as set forth in claim 25, the resistance unit being made from a material providing a low heat conductivity, and the belt being made from a material providing a high heat conductivity relative to the heat conductivity of the resistance unit.

27. In a combination as set forth in claim 26, means extending from one end of the belt for retaining a portion of the user's body.

28. In combination in a personal trainer for support on a support structure to provide exercise for a user, clamping means having a first relationship for disposition on the support structure and having a second relationship for removal from the support structure, gripping means for manual gripping by the user, support means operatively coupled to the clamping means, resistance means operatively coupled to the gripping means, belt means extending between the support means and the resistance means for supporting the gripping means from the clamping means, and holding means supported by the gripping means for providing for the insertion of a selective portion of the user's body into the holding means to facilitate the exercise by the user of muscles in different portions of the user's body dependent upon the selective portion of the user's body inserted into the holding means, the belt means having opposite surfaces, the resistance means being coupled to the opposite surfaces of the belt means for providing a resistance to the opposite surfaces of the belt means, the belt means being made from a material providing a high heat conductivity.

29. In a combination as recited in claim 28, the holding means including an extension of the belt means and the belt means constituting a single belt extending between the support means and the resistance means.

30. In a combination as set forth in claim 29, the resistance means including a plurality of bars made from a material having a low heat conductivity, at least an individual one of the bars engaging one of the opposite surfaces of the belt means and another of the bars engaging the other surface of the belt means.

31. In a combination as set forth in claim 28, the single belt extending in a linear direction between the support means and the resistance means and extending in the linear direction beyond the resistance means.

* * * * *